US005127333A

United States Patent [19]

Theurer

[11] Patent Number: 5,127,333

[45] Date of Patent: Jul. 7, 1992

[54] TRACK MAINTENANCE MACHINE FOR COMPACTING BALLAST

[75] Inventor: Josef Theurer, Vienna, Austria

[73] Assignee: Franz Plasser Bahnbaumaschinen Industriegesellschaft M.B.H., Vienna, Austria

[21] Appl. No.: 637,219

[22] Filed: Jan. 3, 1991

[30] Foreign Application Priority Data

Feb. 6, 1990 [AT] Austria ..... 248/90

[51] Int. Cl.[5] ..... E01B 35/00

[52] U.S. Cl. ..... 104/2; 104/12; 73/146

[58] Field of Search ..... 73/146; 104/7.2, 12, 104/2

[56] References Cited

U.S. PATENT DOCUMENTS 3,807,311 4/1974 Plasser et al. ..... 104/12
3,919,943 11/1975 Plasser et al. ..... 104/12 X
3,926,123 12/1975 Plasser et al. ..... 104/12 X
4,643,101 2/1987 Theurer ..... 104/7.2

FOREIGN PATENT DOCUMENTS 347997 1/1979 Austria .
265188 2/1989 Fed. Rep. of Germany ..... 104/12

OTHER PUBLICATIONS

"Internat. Verkehrswesen", issue Jan. 2, 1981, pp. 1-III-+Engl. translation thereof in Transport International, No. 1, Jun. 1981.

*Primary Examiner*—Robert J. Oberleitner
*Assistant Examiner*—Kevin D. Rutherford
*Attorney, Agent, or Firm*—Collard, Roe & Galgano

[57] ABSTRACT

A continuously advancing track maintenance machine for compacting ballast comprises a self-propelled machine frame supported on the track for continuous advancement, a power-driven and vertically adjustable track stabilization assembly mounted on the machine frame and comprising rail engaging roller tools, a drive for spreading the roller tools into engagement with the gage sides of the rails, and vibrating means for imparting oscillations to the roller tools in a direction extending substantially in a horizontal plane transversely to the longitudinal machine frame extension whereby the roller tools engaging the rails transmit the oscillations to the track, a device for measuring the amplitudes of the horizontal oscillations, and a reference system for monitoring the track level between an actual level of the track and a desired level thereof.

13 Claims, 1 Drawing Sheet

TRACK MAINTENANCE MACHINE FOR COMPACTING BALLAST

BACKGROUND OF THE INVENTION

1. Field of the Invention

The present invention relates to a continuously advancing track maintenance machine for compacting ballast supporting a railroad track comprising two rails fastened to ties, each rail including a head and having a field side and a gage side, which comprises a machine frame having a longitudinal extension substantially parallel to the track, undercarriages supporting the machine frame on the track for continuous advancement in an operating direction, a drive for propelling the machine frame for the continuous advancement thereof, a power-driven, vertically adjustable track stabilization assembly mounted on the machine frame between two of the undercarriages, the track stabilization assembly comprising rail engaging roller tools, drive means for spreading the roller tools into engagement with the gage sides of the rails, and vibrating means for imparting oscillations to the roller tools in a direction extending substantially in a horizontal plane transversely to the longitudinal machine frame extension whereby the roller tools engaging the rails transmit the oscillations to the track, and a reference system for monitoring the track level between an actual level of the track and a desired level thereof.

2. Description of the Prior Art

U S. Pat. No. 4,643,101, dated Feb. 17, 1987, discloses a continuously advancing track leveling, lining and tamping machine to which a machine frame carrying a track stabilization assembly is coupled. The machine frame may also be self-propelled and be used independently of the track leveling, lining and tamping machine. Such track maintenance machines are known as dynamic track stabilizers which considerably improve the track position solidity and particularly the resistance of the track to transverse displacement or misalignment after the track has been leveled and/or lined in a track position correction operation which includes tamping the ties of the corrected track. Since the tie tamping causes the ballast density in the cribs to be reduced, the dynamic track stabilization causes the crib ballast to be compacted so that the track immediately settles in the desired corrected position, which would otherwise be achieved only after a relatively long time by the train traffic over the track. In such a dynamic track stabilization, roller tools of the track stabilization assembly firmly grip the two track rails, and horizontal oscillations extending transversely to the track are imparted to the entire track by eccentric vibrators. At the same time, a static load is applied to the oscillating track by drives exerting a vertical force upon the track stabilization assembly so that the track is "rubbed" into the ballast which is accordingly compacted, causing the level of the track to be lowered. This operation produces not only a more permanent and uniformly elastic ballast bed but also increases the resistance of the track to transverse displacement, which is determined by the friction between the ties and ballast.

The quality of the ballast bed compaction can be derived from the value (QVW) of the resistance of the track to transverse displacement, which determines the positional stability of the track. The ballast bed quality is of particular importance for railroad tracks designed for very high-speed trains. Conventionally, this value has been measured separately from the operation of track maintenance machines. Such a measurement effected at individual ties of the track has been described in an article appearing in the periodical "Internationales Verkehrswesen", issue 1-2/81, pp. I–III (English translation in "Transport International", No. 1, Jun. 1981). In the described measurement, the rail fastening elements are first detached from the tie and the measuring device consisting of a hydraulic cylinder was attached to the tie end after ballast next to it had been removed, whereupon the tie was displaced transversely a small amount. The displacement force as well as the displacement path were measured and the QVW was derived from these measurements. After the measurement, the tie had to be moved back into its original position. This type of measurement requires considerable work and only spot measurements can be made because the ties to be tested must be sufficiently spaced apart to avoid ballast movements causing a reduction in the lateral resistance of the next tie.

SUMMARY OF THE INVENTION

It is the primary object of this invention to provide a track maintenance machine of the first-described type with the capability of measuring the resistance of the track to transverse displacement (QVW) rationally and quickly.

The above and other objects are accomplished in such a machine according to the invention by providing a device for measuring the amplitudes of the horizontal oscillations on the machine.

The present invention is based on the insight that the QVW increases proportionally to an increase in the ballast compaction and the resultant increased friction between the more densely packed ballast and the track ties. Therefore, the horizontal track oscillations will encounter a resistance varying with the degree of ballast compaction, and this will influence the amplitude of the oscillations. In other words, the degree of ballast compaction is inversely proportional to the magnitude of the horizontal track oscillations. The measuring device of this invention for the first time enables these changes in the oscillation amplitude and thus the QVW to be measured continuously as the machine advances along the track. This measurement can be readily effected with a dynamic track stabilizer without much additional structure. Furthermore, the measurements in no way reduce the track stability. Such continuous measurements are of particular importance along stretches of very high-speed track since they will readily spot any track section or point whose lateral stability is low so that such weak track spots may be immediately eliminated by tie tamping or local track stabilization and a uniformly compacted ballast bed providing a constant resistance of the track to transverse displacement is assured.

According to a preferred embodiment, the track maintenance machine of this invention comprises two track stabilization assemblies arranged sequentially in a direction of the longitudinal machine frame extension and spaced from each other in this direction, the measuring device being arranged between the two track stabilization assemblies and being tightly engageable with one of the rails. In this arrangement, the measurement of the oscillation amplitudes of the track is effected at the point of the most powerful oscillations and is, therefore, most accurate and dependable. The tight engagement of the measuring device with the rail assures a complete and shock-free transmission of the track oscillations to the measuring device.

Preferably, the measuring device comprises an oscillation pickup generating an output signal corresponding to the measured oscillations, and a measuring wheel rolling along one of the rails and having two wedge-shaped flanges simultaneously engaging the field and gage sides of the head of the one rail, the oscillation pickup being connected to the measuring wheel. This arrangement assures the instant transmission of any horizontal displacement of the track in a transverse direction to the measuring wheel and to the pickup connected thereto. The wedge-shaped wheel flanges will keep the wheel in tight engagement with both sides of the rail even when the rail head is worn. The wheel is supported on an axial bearing and the pickup is preferably affixed to the axial bearing. This arrangement of the pickup enables the horizontal track oscillations to be received most readily and directly through the measuring wheel.

According to another preferred feature, a resilient bearing is interposed between the measuring device and the machine frame or a rail sensing element of the track level reference system. Such an elastic bearing for the measuring device avoids any falsification of the measurements by oscillations of the machine frame or the reference system sensing element.

Very advantageously, the measuring device is adapted for the continuous measurement of the horizontal oscillation amplitudes of the track and may comprise an optoelectronic sensor connected to the machine frame for optically sensing one of the rails or a reference base in tight engagement with one of the rails. This enables the oscillation amplitudes to be measured without contact from the machine frame. In this way, the measuring device is not subjected to the constantly high transverse acceleration forces of the oscillating track. The accuracy of this contact-free measurement will be enhanced if the reference base comprises a luminescent diode.

In a further embodiment, the track maintenance machine may comprise a further device for measuring the horizontal oscillation amplitudes connected to one of the track stabilization assemblies. This provides a control of the measurement of the first measuring device, a divergence between the measuring results of the two devices leading to certain conclusions, for example the presence of faulty rail fastening.

A very simple measuring device capable of withstanding high loads is a two-part capacitative receiver monitoring the path of the oscillations and having one part connected to the machine frame and another part connected to a measuring wheel guided tightly along one of the rails.

The present invention also provides a method of measuring the resistance of a railroad track to transverse displacement, which comprises the steps of continuously advancing a track maintenance machine along the track while causing the continuously advancing machine to impart oscillations to the track in a horizontal direction extending transversely to the track, and continuously measuring the amplitude of the track oscillations. This method makes it possible for the first time continuously to measure and to control the QVW value of a track, which determines its resistance to misalignment. In this manner, even inhomogeneities of the ballast density limited to very short stretches of track can be dependably detected since the measurement is made continuously along the entire track. Thus, very high-speed track is ready for traffic immediately after the measurements and possible track corrections have been effected. At the same time, this track control method in no way changes the track position. Such a continuous oscillation amplitude measurement during the operation of a dynamic track stabilizer can also provide data for the type of track work that may be required. For example, heavily encrusted or broken-up ballast will give QVW values differing from those measured in a track section where the ballast is insufficiently compacted, thus indicating the necessity for ballast cleaning rather than tamping. The track oscillation amplitude readings will also indicate track sections where the rail fastening is loose, tie plates are missing or other defects are present in the rail fastening.

In a preferred embodiment of the measuring method, a track stabilization assembly on the track maintenance machine is vibrated to impart the oscillations to the track in a track stabilization operation, and the amplitude of the track oscillations is continuously measured in a subsequent measuring operation, the frequency of the horizontal vibrations of the track stabilization assembly being reduced in the measuring operation from that of the stabilization operation. In this way, it is possible to control the quality of the track stabilization rapidly and optimally within certain parameters which are optimal for the measuring operation so that any problem spots which do not meet the required resistance to transverse track displacement may be detected immediately after the track stabilization operation. Any detected inhomogeneity in the ballast compaction can then be eliminated immediately after the measuring operation with the same machine by compacting the ballast and settling the track at the detected problem spots.

BRIEF DESCRIPTION OF DRAWING

The above and other objects, advantages and features of the present invention will become more apparent from the following detailed description of certain now preferred embodiments thereof, taken in conjunction with the accompanying, partly diagrammatic drawing wherein.

DETAILED DESCRIPTION OF PREFERRED EMBODIMENTS

Figure 1:
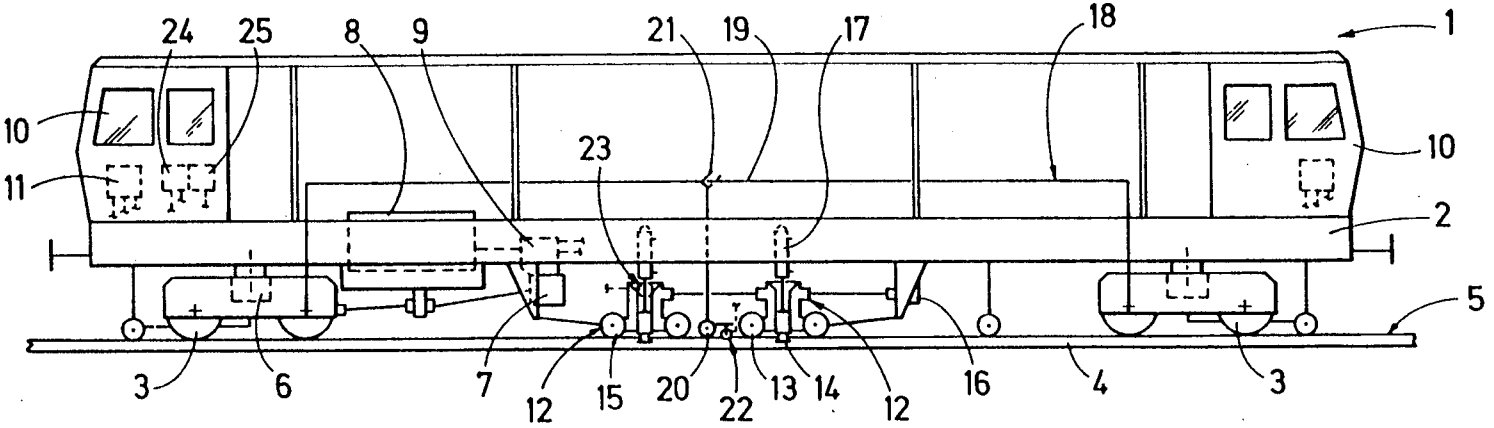
FIG. 1 is a side elevational view of a track maintenance machine incorporating a measuring device according to this invention.

Referring now to the drawing and first to FIG. 1, there is shown continuously advancing track maintenance machine 1 for compacting ballast supporting railroad track 5 comprising two rails 4 fastened to ties, each rail including a head and having a field side and a gage side. The illustrated track maintenance machine is a generally dynamic track stabilizer which comprises elongated machine frame 2 having a longitudinal extension substantially parallel to the track, and widely spaced undercarriages 3, 3 support machine frame 2 on track 5 for continuous advancement in an operating direction. Respective drive 6, 6 is associated with each undercarriage for propelling the machine frame for the continuous advancement thereof, and the machine has also an additional, hydro-dynamic drive used to propel the machine during transit between operating sites. The machine frame carries central power plant 8 and hydraulic unit 9 for operating all the operating drives of the machine. An operator's cab 10 is mounted on machine frame 2 at each end thereof and each cab holds control panel 11 so that an operator in the cab may drive the machine and control the operation thereof.

Machine 1 further comprises two power-driven, vertically adjustable track stabilization assemblies 12 mounted between the two undercarriages on machine frame 2 sequentially in a direction of the longitudinal machine frame extension and spaced from each other in this direction. Each generally conventional track stabilization assembly 12 comprises rail engaging roller tools 15 gripping the rails and constituted by a pair of flanged rollers 13 whose flanges are adjacent the gage sides of rails 4 and rollers 14 intermediate the flanged rollers and having flanges subtending the rail heads at the field sides of the rails. Drive means are linked to flanged rollers 13 of the roller tools for spreading the rollers into engagement with the gage sides of the rails, and vibrators 16 impart oscillations to roller tools 15 in a direction extending substantially in a horizontal plane transversely to the longitudinal machine frame extension whereby the roller tools engaging rails 4 transmit the oscillations to track 5. Vertically extending hydraulic cylinder drives 17 link track stabilization assemblies 12 to machine frame 2 for transmitting a static load to track 5. Track maintenance machine 1 also carries reference system 18 for monitoring the track level between an actual level of the track and a desired level thereof, and the settling of track 5 due to the operation of track stabilization assemblies 12 is controlled by this reference system to obtain the desired track level. The reference base of leveling reference system 18 is constituted by reference wires 19 tensioned between undercarriages 3, 3 above each rail 4, and the reference system further comprises vertically freely adjustable rail sensing element 20 arranged between the track stabilization assemblies and constituted by flanged rollers running on rails 4 and supporting track level sensors 21 cooperating with tensioned reference wires 19. All of this structure and the controlled track leveling operation by a dynamic track stabilizer are conventional.

According to this invention, the machine also carries a device 22 for measuring the amplitudes of the horizontal oscillations of track 5, the measuring device being arranged between the two track stabilization assemblies and being tightly engageable with one of the rails. In the illustrated embodiment, oscillation amplitude measuring device 22 is connected to rail sensing element 20 of the leveling reference system, and machine 1 further comprises additional measuring device 23 arranged on one of the track stabilization assemblies 12 and constituted by an oscillation pickup measuring the amplitude of its oscillations and generating an output signal corresponding to the measured oscillation amplitude whereby the measurements of measuring device 22 may be monitored. A recording instrument 24 and a track geometry computer 25 of conventional design are mounted in one of the operator's cabs 10, which receive the output signals from oscillation amplitude devices 22, 23 and record the measured data obtained by measuring devices 22, 23 and process them for further use in subsequent track maintenance work.

Figure 3:
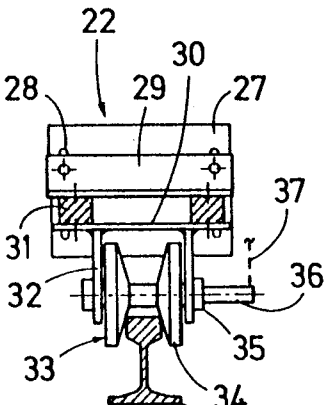
FIG. 3 is an end view of the measuring device, taking in the direction of arrow III of FIG. 2.
Figure 2:
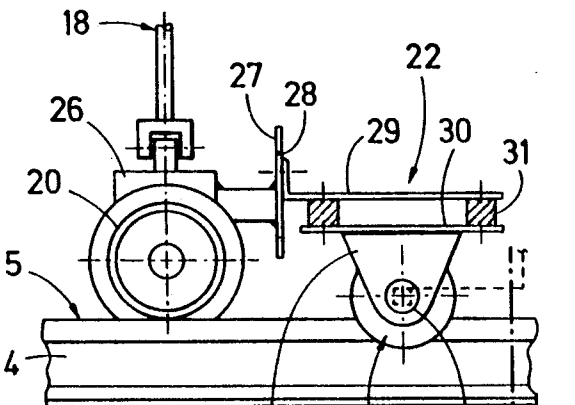
FIG. 2 is a fragmentary, enlarged side elevational view of the machine of FIG. 1, showing the measuring device.

FIGS. 2 and 3 show the structure of measuring device 22. The flanged rollers of track sensing element 20 are interconnected by axle 26 and vertically extending guide plate 27 is affixed to the axle in vertical alignment with one of the rails 4. The guide plate defines two vertically extending slots 28 at respective sides of rail 4, and mounting plate 29 defining a plane extending substantially parallel to the plane of track 5 is vertically adjustably guided and detachably mounted in vertical slots 28 of guide plate 27. Carrier plate 30 extends parallel to, and below, mounting plate 29 and rubber bearings 31 resiliently connect carrier plate 30 to mounting plate 29. The carrier plate has downwardly projecting bearing brackets 32 for measuring wheel 33 which rolls along rail 4 and has two wedge-shaped flanges 34 simultaneously engaging the field and gage sides of the head of rail 4. Axial bearing 35 supports measuring wheel 33 on bearing brackets 32 and oscillation pickup 36 is affixed to the axial bearing for the continuous measurement of the amplitude of the horizontal oscillations of track 5, which is a function of the transverse displacement path of rail 4 and measuring wheel 33 tightly engaging the same. Rubber bearings 31 constitute a resilient bearing connecting the measuring device to the machine frame 2 or, more particularly, to rail sensing element 20 of the track level reference system. Oscillation pickup 36, as well as oscillation amplitude measuring device 23 mounted directly on track stabilization assembly 12, may take any suitable form, and may be an electrodynamic, inductive, capacitative, ohmic, piezoelectric or like instrument capable of continuously measuring the path or amplitude of an oscillating element and emitting an output signal corresponding thereto.

Referring to track maintenance machine 1 illustrated in FIGS. 1 to 3, the operation of the machine will now be described in detail:

After the position of track 5 has been corrected by a track leveling, lining and tamping machine, the corrected track is stabilized by passing dynamic track stabilizer 1 over the corrected track to compact the ballast and settle the track in its permanent position, i.e. to avoid settling of the corrected track under the load of the initial train traffic and to simulate this load under the controlled action of the dynamic track stabilizer. Immediately following this first pass of track maintenance machine 1 over the corrected track, the machine is again continuously propelled over the now stabilized track section, with measuring wheel 33 lowered into engagement with rail 4. During this second pass of the machine over stabilized track 5, however, track stabilization assembly 12 is operated not to compact the ballast and settle the track further but only sufficiently to cause some horizontal oscillation of the track. Therefore, vibrator 16 is operated at a much lower frequency than during the dynamic track stabilization in the first pass of the machine, and the static load on the track produced by hydraulic drives 17 is also reduced considerably. Instrument 36 now continuously measures the horizontal track oscillations by monitoring and measuring the horizontal path of measuring wheel 33 which is in tight engagement with horizontally oscillating rail 4 and, therefore, oscillates therewith. As a control, measuring device 23 affixed to second track stabilization assembly 12 may be operated to measure at the same time the amplitude of the horizontal oscillations imparted by this track stabilization assembly. The oscillation amplitude measurement signals emitted by receivers 22, 23 are transmitted by lines 37 to measurement recorder 24 and are stored and processed in track geometry computer 25. When the recorder and/or computer indicate measured QVW values exceeding predetermined desired limits of the resistance of the track to transverse displacement, such problem spots along track 5 are immediately corrected by the renewed use of a track leveling, lining and tamping machine and/or a dynamic track stabilizer. The track section is then ready for very high-speed train traffic.

The measurement results are also useful as indicators of other ballast conditions requiring improvement. Thus, since heavily encrusted or substantially broken-up ballast will yield different measurement results than ballast in good but merely insufficiently compacted condition, the measurements will indicate the need for a ballast cleaning and renewal. The measurement results will also indicate loose or otherwise defective rail fastenings and the absence of tie plates.

It is also possible to use the measurement of the QVW value before track position correction work is begun, i.e. to pass track maintenance machine 1 over track 5 in a measurement operation to detect particular problem spots for special attention during a subsequent track leveling, lining, tamping and stabilizing operation.

Figure 4:
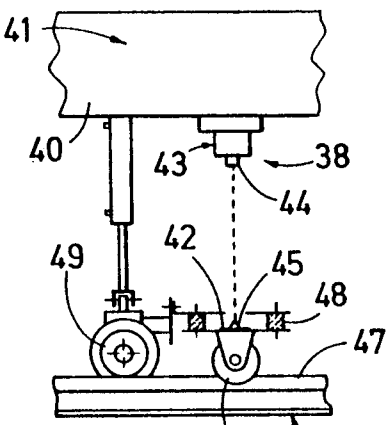
FIG. 4 is a view similar to that of FIG. 2 and illustrating another embodiment of the measuring device.

In the embodiment illustrated in FIG. 4, measuring device 38 adapted for the continuous measurement of the horizontal oscillation amplitudes of track 39 comprises optoelectronic sensor 43 connected to machine frame 40 of dynamic track stabilizer 41 for optically sensing one of the rails 47 of track 39 or a reference base in tight engagement with the rail. This reference base is comprised of measuring wheel 46 whose wedge-shaped flanges are in tight engagement with rail 47, similarly to measuring wheel 33. Sensor 43 has CCD-(charge coupled device) lines having a multiplicity of light-sensitive crystals. The light photons generate charge carriers at the impinged points of the crystals so that a charge image of the brightness values is created in the crystal. Optoelectronic sensor 43 has objective 44 focused on luminescent diode 45 affixed to measuring wheel 46 constituting the reference base. Rubber bearings 48 connect the measuring wheel to vertically adjustable track sensing element 49 of a track leveling reference system in a manner described more fully in connection with the embodiment of FIG. 2. The light of luminescent diode 45, which oscillates with track 39 whose rail 47 it tightly engages, generates a corresponding charge image in the CCD-lines of sensor 43, for an exact measurement of the amplitudes of the horizontal oscillations of track 39. Objective 44 of optoelectronic sensor 43 is so adjusted that it focusses on the entire transverse displacement path of luminescent diode 45 in a track curve in which the diode is transversely displaced with respect to machine frame 40 so that the oscillation amplitudes may be measured in tangent track as well as in track curves.

Figure 5:
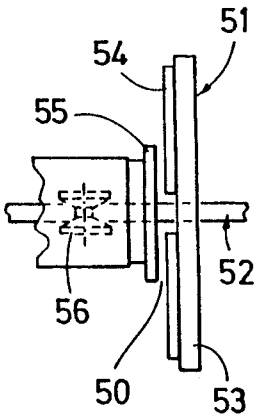
FIG. 5 is a highly schematic and simplified top view of a third embodiment of the measuring device.

FIG. 5 illustrates yet another embodiment, wherein measuring device 51 is a two-part capacitative receiver 50 monitoring the path of the horizontal oscillations of track 52, i.e. the oscillation amplitude. Receiver 50 is a differential condenser having one part consisting of two condenser plates 54 connected to machine frame 53 of a track maintenance machine and another part consisting of a third condenser plate 55 connected to measuring wheel 56 guided tightly along one of the rails of track 52 in the manner described in connection with the previously described embodiments. The horizontal oscillations of the track cause a corresponding displacement of centered condenser plate 55 with respect to the two facing condenser plates 54, causing an accurately measurable change in the charge, which is proportional to the amplitude of the track oscillations.

What is claimed is:

1. A continuously advancing track maintenance machine for compacting ballast supporting a railroad track comprising two rails fastened to ties, each rail including a head and having a field side and a gage side, which comprises (a) a machine frame having a longitudinal extension substantially parallel to the track, (b) undercarriages supporting the machine frame on the track for continuous advancement in an operating direction, (c) a drive for propelling the machine frame for the continuous advancement thereof, (d) a power-driven, vertically adjustable track stabilization assembly mounted on the machine frame between two of the undercarriages, the track stabilization assembly comprising (1) rail engaging roller tools arranged to be spread into engagement with the gage sides of the rails, and (2) vibrating means for imparting oscillations to the roller tools in a direction extending substantially in a horizontal plane transversely to the longitudinal machine frame extension whereby the roller tools engaging the rails transmit the oscillations to the track, (e) a device for measuring the amplitudes of the horizontal oscillations, and (f) a reference system for monitoring the track level between an actual level of the track and a desired level thereof.

2. The track maintenance machine of claim 1, wherein the measuring device is adapted for the continuous measurement of the horizontal oscillation amplitudes of the track and comprises an optoelectronic sensor connected to the machine frame for optically sensing a reference base in tight engagement with one of the rails and oscillating therewith.

3. The track maintenance machine of claim 2, wherein the reference base comprises a luminescent diode.

4. The track maintenance machine of claim 1, wherein the measuring device is adapted for the continuous measurement of the horizontal oscillation amplitudes of the track and comprises an optoelectronic sensor connected to the machine frame for optically sensing one of the rails.

5. A method of measuring the resistance of a railroad track to transverse displacement, which comprises the steps of (a) continuously advancing a track maintenance machine along the track while causing the continuously advancing machine to impart oscillations to the track in a horizontal direction extending transversely to the track, and (b) continuously measuring the amplitude of the track oscillations.

6. The measuring method of claim 5, wherein a track stabilization assembly on the track maintenance machine is vibrated to impart the oscillations to the track in a track stabilization operation, and the amplitude of the track oscillations is continuously measured in a subsequent measuring operation, the frequency of the horizontal vibrations of the track stabilization assembly being reduced in the measuring operation from that of the stabilization operation.

7. A continuously advancing track maintenance machine for compacting ballast supporting a railroad track comprising two rails fastened to ties, each rail including a head and having a field side and a gage side, which comprises (a) a machine frame having a longitudinal extension substantially parallel to the track, (b) undercarriages supporting the machine frame on the track for continuous advancement in an operating direction, (c) a drive for propelling the machine frame for the continuous advancement thereof, (d) two power-driven, vertically adjustable track stabilization assemblies mounted on the machine frame sequentially in a direction of the longitudinal machine frame extension and spaced from each other in said direction between two of the undercarriages, each track stabilization assembly comprising (1) rail engaging roller tools arranged to be spread into engagement with the gage sides of the rails, and (2) vibrating means for imparting oscillations to the roller tools in a direction extending substantially in a horizontal plane transversely to the longitudinal machine frame extension whereby the roller tools engaging the rails transmit the oscillations to the track, (e) a device for measuring the amplitudes of the horizontal oscillations arranged between the two track stabilization assemblies and being tightly engageable with one of the rails, and (f) a reference system for monitoring the track level between an actual level of the track and a desired level thereof.

8. The track maintenance machine of claim 7, comprising a further device for measuring the horizontal oscillation amplitudes connected to one of the track stabilization assemblies.

9. A continuously advancing track maintenance machine for compacting ballast supporting a railroad track comprising two rails fastened to ties, each rail including a head and having a field side and a gage side, which comprises (a) a machine frame having a longitudinal extension substantially parallel to the track, (b) undercarriages supporting the machine frame on the track for continuous advancement in an operating direction, (c) a drive for propelling the machine frame for the continuous advancement thereof, (d) a power-driven, vertically adjustable track stabilization assembly mounted on the machine frame between two of the undercarriages, the track stabilization assembly comprising (1) rail engaging roller tools arranged to be spread into engagement with the gage sides of the rails, and (2) vibrating means for imparting oscillations to the roller tools in a direction extending substantially in a horizontal plane transversely to the longitudinal machine frame extension whereby the roller tools engaging the rails transmit the oscillations to the track, (e) a device for measuring the amplitudes of the horizontal oscillations, the measuring device comprising (1) an oscillation pickup instrument measuring the path of the oscillations and generating a corresponding output signal, and (2) a measuring wheel rolling along one of the rails and having two wedge-shaped flanges simultaneously engaging the field and gage sides of the head of the one rail, the instrument being connected to the measuring wheel, and (f) a reference system for monitoring the track level between an actual level of the track and a desired level thereof.

10. The track maintenance machine of claim 9, further comprising an axial bearing for the measuring wheel, and wherein the instrument is affixed to the axial bearing.

11. A continuously advancing track maintenance machine for compacting ballast supporting a railroad track comprising two rails fastened to ties, each rail including a head and having a field side and a gage side, which comprises (a) a machine frame having a longitudinal extension substantially parallel to the track, (b) undercarriages supporting the machine frame on the track for continuous advancement in an operating direction, (c) a drive for propelling the machine frame for the continuous advancement thereof, (d) a power-driven, vertically adjustable track stabilization assembly mounted on the machine frame between two of the undercarriages, the track stabilization assembly comprising (1) rail engaging roller tools arranged to be spread into engagement with the gage sides of the rails, and (2) vibrating means for imparting oscillations to the roller tools in a direction extending substantially in a horizontal plane transversely to the longitudinal machine frame extension whereby the roller tools engaging the rails transmit the oscillations to the track, (e) a device for measuring the amplitudes of the horizontal oscillations, (f) a resilient bearing between the machine frame and the measuring device for cushioning the measuring device, and (g) a reference system for monitoring the track level between an actual level of the track and a desired level thereof.

12. A continuously advancing track maintenance machine for compacting ballast supporting a railroad track comprising two rails fastened to ties, each rail including a head and having a field side and a gage side, which comprises (a) a machine frame having a longitudinal extension substantially parallel to the track, (b) undercarriages supporting the machine frame on the track for continuous advancement in an operating direction, (c) a drive for propelling the machine frame for the continuous advancement thereof, (d) a power-driven, vertically adjustable track stabilization assembly mounted on the machine frame between two of the undercarriages, the track stabilization assembly comprising (1) rail engaging roller tools arranged to be spread into engagement with the gage sides of the rails, and (2) vibrating means for imparting oscillations to the roller tools in a direction extending substantially in a horizontal plane transversely to the longitudinal machine frame extension whereby the roller tools engaging the rails transmit the oscillations to the track, (e) a device for measuring the amplitudes of the horizontal oscillations, (f) a reference system comprising a rail sensing element for monitoring the track level between an actual level of the track and a desired level thereof, and (g) a resilient bearing connecting the measuring device to the rail sensing element of the track level reference system.

13. A continuously advancing track maintenance machine for compacting ballast supporting a railroad track comprising two rails fastened to ties, each rail including a head and having a field side and a gage side, which comprises (a) a machine frame having a longitudinal extension substantially parallel to the track, (b) undercarriages supporting the machine frame on the track for continuous advancement in an operating direction, (c) a drive for propelling the machine frame for the continuous advancement thereof, (d) a power-driven, vertically adjustable track stabilization assembly mounted on the machine frame between two of the undercarriages, the track stabilization assembly comprising (1) rail engaging roller tools arranged to be spread into engagement with the gage sides of the rails, and (2) vibrating means for imparting oscillations to the roller tools in a direction extending substantially in a horizontal plane transversely to the longitudinal machine frame extension whereby the roller tools engaging the rails transmit the oscillations to the track, (e) a device for measuring the amplitudes of the horizontal oscillations, the measuring device being a two-part capacitive receiver monitoring the path of oscillations and having one part connected to the machine frame and another part connected to a measuring wheel guided tightly along one of the rails, and (f) a reference system for monitoring the track level between an actual level of the track and a desired level thereof.

* * * * *